United States Patent [19]

Bachert

[11] 4,125,447

[45] Nov. 14, 1978

[54] MEANS FOR PLATING THE INNER SURFACE OF TUBES

[76] Inventor: Karl R. Bachert, 386 Woodward Ave., Brooklyn, N.Y. 11237

[21] Appl. No.: 889,631

[22] Filed: Mar. 24, 1978

[51] Int. Cl.[2] ..... C25D 17/00; C25D 17/10; C25D 21/10

[52] U.S. Cl. ..... 204/222; 204/26; 204/DIG. 10

[58] Field of Search ..... 204/222, 223, DIG. 10, 204/26

[56] References Cited

U.S. PATENT DOCUMENTS

| | | | |
|---|---|---|---|
| 313,569 | 3/1985 | Appleton | 204/DIG. 10 |
| 1,733,404 | 10/1929 | Fahrenwald | 204/222 |
| 1,927,162 | 9/1933 | Fiedler et al. | 204/26 |
| 3,223,600 | 12/1965 | Anderson | 204/223 |

FOREIGN PATENT DOCUMENTS

| | | | |
|---|---|---|---|
| 18,643 of | 1899 | United Kingdom | 209/DIG. 10 |
| 331,104 | 6/1930 | United Kingdom | 204/26 |

*Primary Examiner*—T. M. Tufariello
*Attorney, Agent, or Firm*—James P. Malone

[57] ABSTRACT

Means for plating the inside of metal cylinders. A tube or pipe to be plated is mounted in a mounting which seals the ends of the tube. Oscillatable means mount an anode so that the anode extends through the tube. A pump circulates an electrolyte through the tube. A source of electricity connected between the anode and the tube. A brush is connected to the anode to scrub the interior surface of the tube as the anode oscillates, to provide a uniform surface.

1 Claim, 2 Drawing Figures

MEANS FOR PLATING THE INNER SURFACE OF TUBES

This invention relates to electroplating and more particular to means for electroplating the inner surface of tubes.

In some applications, it is necessary to electroplate the inner surface of metal tubes. It is somewhat difficult to get a good uniform plating on the inside of these metal tubes. The present invention solves this problem by mounting the tube so that the ends are sealed but with an oscillating anode extending through the tube along the axis thereof. An electrolyte is pumped through the tube. A source of electricity is connected between the tube and the anode. The reciprocating anode together with the flow of the electrolyte scrubs and washes the interior surface of the tube during plating and tends to remove plating material that does not have good adhesion. This results in a good uniform surface plating of the interior of the tube.

Accordingly, a principal object of the invention is to provide new and improved means for plating the inside of the metal tubes.

Another object of the invention is to provide new and improved means for plating the inside of metal tubes having means to reciprocate the anode and pump electrolyte through the tube to thereby remove plating material that does not have good adhesion.

Another object of the invention is to provide new and improved means for plating the inside of metal tubes comprising, means to mount a tube to be plated including means to seal the ends of the tube, oscillatable means adopted to mount an anode so that the anode extends through the tube, means to connect to circulate an electrolyte through the tube and a source of electricity connected between the anode and the tube.

These and other objects of the invention will be apparent from the following Specification and drawings.

Figure 1:
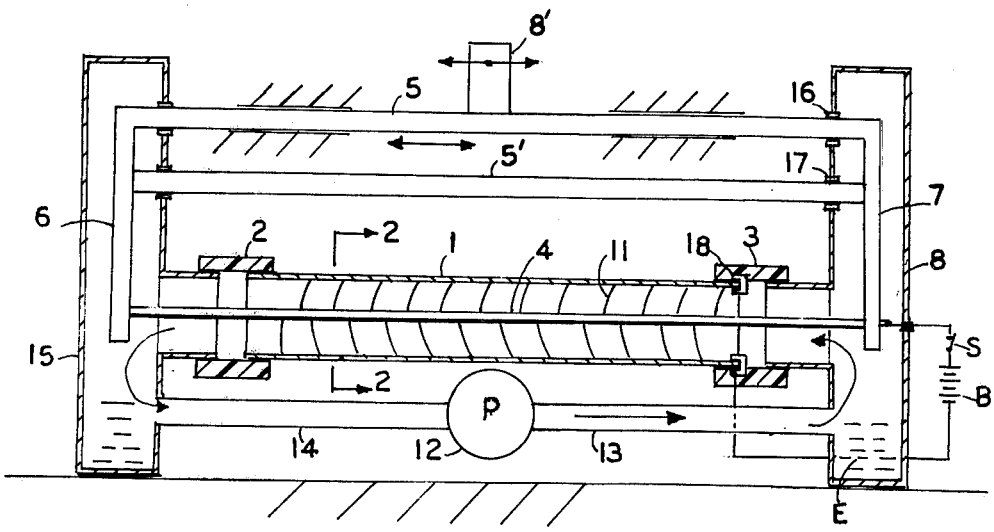
FIG. 1 is a side partly sectional view of an embodiment of the invention.
Figure 2:
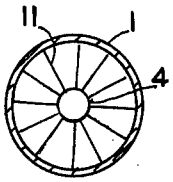
FIG. 2 is a sectional view along the line 2—2 of FIG. 1.

Referring to the drawings, the tube 1, is mounted in a stationary manner by means of slidable elastic end seals 2 and 3, for instance of rubber. The anode 4 is mounted on a frame 5, 5' having end pieces 6 and 7, for oscillation. The frame is oscillated by means of the rod member 8', which is oscillated by conventional means, not shown. The members 5, 5' extend through the seals 16, 17, etc., in the manifolds 8 and 15. Frame 15 is of insulating material.

The electrolyte E which may be an acidic solution, is pumped by means of the pump 12, through the pipe 13, which is connected to manifold 8. The electrolyte returns by means of the return pipe 14 and manifold 15. A reservoir may be incorporated if desired.

A battery B or other source of DC electricity is connected from the tube 1 on its negative side to the anode 4 at its positive side through switch S. The connection to tube 1 is preferably made by conductive ring 18 in connector 3. Electrical contact may be made to the outside or inside surfaces, or both, of the tube 1.

The anode 4 has affixed to it a plurality of bristles 11, which may be of plastic or other insulating material, which rub against the inside surface of the tube as the anode 4 vibrates. The anode may be formed of twisted wires to mount the bristles.

A plurality of tubes and anodes may be mounted between the manifolds 8 and 15 if desired.

Therefore, during the plating process the anode oscillates and the electrolyte circulates through the tube so that there is an agitation, scrubbing and/or washing action inside the tube 1. This action tends to remove any plating material which does not have good adhesion and results in a uniform plated surface on the tube. The end seals 2 and 3 are made of an electrically insulating material which is also impervious to the electrolyte acid content. The end seals 2 and 3 may be attached to the tube with a friction fit which is tight enough to prevent leakage of the electrolyte. The bristles maintain the concentricity of anode 4 which helps to provide a more uniform plating.

It is claimed:

1. Means for plating the inside of hollow open ended members comprising, means to mount a tube to be plated including means to seal the ends of the tube, an anode, oscillatable means adapted to mount the anode so that the anode extends through the hollow member, means connected to circulate an electrolyte through the hollow member, a source of electricity connected between the anode and the inside surface of the hollow member, and a plurality of insulating bristles mounted on the anode to scrub the interior surface of the tube as the anode vibrates, and maintain the concentricity of the anode to provide a more uniform plating.

* * * * *